US009981171B2

(12) United States Patent
Topolosky

(10) Patent No.: US 9,981,171 B2
(45) Date of Patent: May 29, 2018

(54) EDIBLE DEVICE FOR HARD LIQUOR BEER PONG ALTERNATIVE

(71) Applicant: Gary P. Topolosky, Pittsburgh, PA (US)

(72) Inventor: Gary P. Topolosky, Pittsburgh, PA (US)

( * ) Notice: Subject to any disclaimer, the term of this patent is extended or adjusted under 35 U.S.C. 154(b) by 0 days. days.

(21) Appl. No.: 15/666,282

(22) Filed: Aug. 1, 2017

(65) Prior Publication Data

US 2017/0326425 A1 Nov. 16, 2017

Related U.S. Application Data

(63) Continuation-in-part of application No. 15/488,447, filed on Apr. 15, 2017, and a continuation-in-part of application No. 14/746,658, filed on Jun. 22, 2015, now abandoned, and a continuation of application No. 14/149,775, filed on Jan. 7, 2014, now Pat. No. 9,079,087.

(51) Int. Cl.

| | |
|---|---|
| ***A63B 67/06*** | (2006.01) |
| ***A63B 63/08*** | (2006.01) |
| ***A63F 7/00*** | (2006.01) |
| ***B65D 21/02*** | (2006.01) |
| ***B65D 25/20*** | (2006.01) |
| *A63F 9/00* | (2006.01) |
| *A44C 5/00* | (2006.01) |

(52) U.S. Cl.

CPC ..... *A63B 67/06* (2013.01); *A63B 63/08* (2013.01); *A63F 7/0017* (2013.01); *B65D 21/0233* (2013.01); *B65D 25/205* (2013.01); *A44C 5/0007* (2013.01); *A63B 2210/50* (2013.01); *A63F 2009/0053* (2013.01); *A63F 2009/0058* (2013.01); *A63F 2250/024* (2013.01)

(58) Field of Classification Search

CPC ..... A63B 67/06; A63B 63/08; A63B 2210/50; A63F 7/0017; A63F 2009/0053; A63F 2250/024; A63F 2009/0058

USPC ..... 248/311.2, 315, 318; 220/737, 694, 703, 220/710.5, 738, 669, 646; 217/217

See application file for complete search history.

(56) References Cited

U.S. PATENT DOCUMENTS

| | | | | |
|---|---|---|---|---|
| 5,170,695 | A * | 12/1992 | Chang | A47J 45/062 220/737 |
| D516,872 | S * | 3/2006 | Rigberg | D7/619.1 |
| 2009/0008525 | A1* | 1/2009 | Chekroune | A45F 5/02 248/312 |
| 2014/0251494 | A1* | 9/2014 | Stieger | A47J 31/4403 141/1 |

* cited by examiner

*Primary Examiner* — Kareen Thomas
(74) *Attorney, Agent, or Firm* — Gary P. Topolosky

(57) ABSTRACT

An edible adapter device that enables smaller drinking cups to fit within larger drinking cups for a modified beer pong-drinking game. The device comprises a continuous band that is either flexible or rigid but can be worn about a human wrist as a drink counter or consumed when made from candy, a cookie material, pretzel, compressed cereal or a cracker.

20 Claims, 3 Drawing Sheets

EDIBLE DEVICE FOR HARD LIQUOR BEER PONG ALTERNATIVE

CROSS-REFERENCE TO RELATED APPLICATIONS

This is a continuation-in-part of U.S. application Ser. No. 15/488,447, filed on Apr. 15, 2017, which is a continuation-in-part of U.S. application Ser. No. 14/746,658, filed on Jun. 22, 2015, which is a continuation of U.S. application Ser. No. 14/149,775, filed on Jan. 7, 2014, now U.S. Pat. No. 9,079,087 that issued on Jul. 14, 2015, all disclosures of which are fully incorporated by reference herein.

BACKGROUND OF THE INVENTION

The present invention relates to the popular drinking game known as beer pong, apparently known in some locations as "Beirut". It involves bouncing ping pong balls on a flat surface into a series of standard party/beer drinking cups containing beer or another liquid beverage. Depending on the rules established before a game starts, if one lands her/her bounced ping pong ball into a cup, the bouncing player can either drink the cup contents or dictate that another player of his/her choice drink. The empty cup is removed leaving fewer targets to aim for. See also, Radhakrishnan U.S. Published Application No. 2006/0027971 for other rule variations.

The game has become so well known that there are college pong leagues and intercollegiate teams. Sophisticated pong-related devices have been disclosed including the table with cooling system of Herro et al U.S. Pat. No. 8,235,389, and electromechanical moving target table from Hoffer U.S. Pat. No. 8,028,995. There's an arcade game version per Lombardi U.S. Pat. No. 8,146,921. And the elaborate apparatus of Max et al U.S. Published Application No. 2012/0225742 includes a rounded backboard on a stand with netting. While the latter showed different sized holes, not all are meant to hold standard size drinking cups.

Numerous other pong-playing accessories have been disclosed. These include the cup holder of Webb et al U.S. Pat. No. 7,805,959 and pong cup arranging device of McDonnell et al U.S. Published Application No. 2011/0220665. A portable table, that also floats, is the subject of Brown U.S. Published Application No. 2012/0256378.

The typical pong playing cup in a 10, 12, or 16 oz. size made from polystyrene is most often aligned on a flat table, or situated like the 10 pins of bowling (rows of 1, 2, 3 and then 4) into holes for suspending from the cup rims. Red cups of these ilk are so popular as to justify country song lore. See, Toby Keith's "Red Solo Cup". These "larger" size cups are not meant to be fully filled (to the brim) with beer during play. A bounced pong ball is only meant to land in a cup half filled or less for the winning bouncer to drink from or designate somebody else to drink empty. For hard liquors and even semi-solid drinks (like Jello® shots), these cups are too large. A typical shot glass would hold much less alcohol, whether its whiskey, rum, gin or numerous other alternatives.

What is needed is a device for situating on or about smaller drinking disposable cups, of the 5, 7 or 8 oz. variety, most often clear and made from PET, for situating IN the standard larger pong drinking cup. This invention addresses that need with Pong Size Adapters or "PSA's", more affectionately referred to herein as cup rim adapters or Rimmerz™ (or alternately, Rimshotz™).

SUMMARY OF THE INVENTION

It is an object of this invention to provide devices letting smaller drinking cups fit inside larger drinking cups for multiple levels of alcohol (especially non-beer) consumption. It is another object to provide such devices for reuse or for removal and collection during a typical game play. It is another main object of this invention to provide devices as color coordinated collectibles, and/or for use by alcohol and other product/service advertising. It is still another main object of the present invention to make such Rimmerz devices from edible materials (including cookies, crackers and various candy products). One variation of this modified Beer Pong game may be known as BoozPong™.

BRIEF DESCRIPTION OF DRAWINGS

Further features, objectives and advantages will become clearer with the detailed description made with reference to the accompanying drawings in which.

DETAILED DESCRIPTION OF PREFERRED EMBODIMENTS

Figure 1:
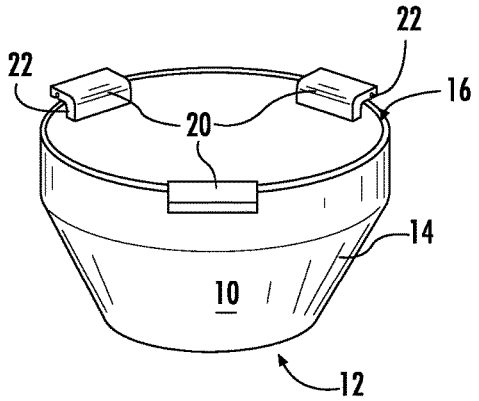
FIG. 1 is a top perspective view of a first embodiment of the invention, showing spaced apart clips to the rim of a standard size, small plastic cup.

Referring now to the drawings, there is shown several embodiments of device, according to the invention. In the accompanying drawings, common elements are commonly numbered in the respective views. For the alternative embodiments, common elements are consistently numbered though in the next hundred series.

With the present invention, smaller diameter cups (for serving drinks other than beer) can be fitted at or around their top cup perimeter (rim) with lipped spacers/clips affixed at at least 120 degree points for sitting/situating in the confines of a larger, standard beer pong/drinking cup. This variety of Rimmerz is shown in accompanying FIG. 1. More particularly, smaller clear plastic cup 10 has a flat base 12 with a curved sidewall 14 that terminates in top rim 16. In the first embodiment of this invention, there are situated at least 3 individualized Rimmerz clips, generally 20, each clip being generally U-shaped with a slit or slotted bottom 22 for sitting directly on a section of top rim 16 to cup 10. Depending on the overall length of each clip, they may have some flexibility and/or some intentional curvature added so as to better fit along longer sections of cup rims.

Figure 5:
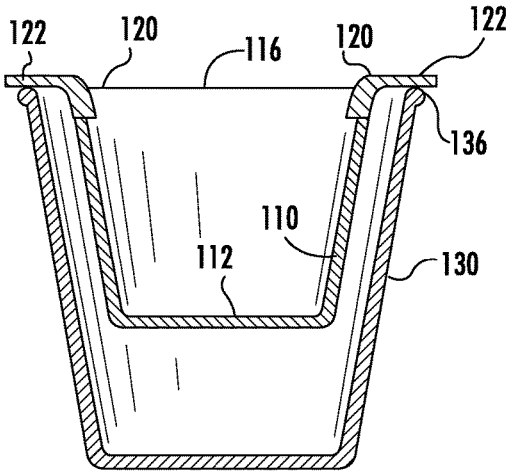
FIG. 5 is a sectional view of a top mounted device affixed to a cup situated along the upper rim to the larger cup according to one embodiment of this invention.

In an alternate variation, better seen in cross-section at FIG. 5, those plurality of clips 120 each have an outermost ledge 124, preferably planar in cross-section, for more easily resting that inner cup 110 onto the uppermost rim of beer cup 130, at least on its uppermost rim 136. FIG. 5 shows, in cross-section, how a top-situated Rimmerz will rest in and along the normal sipping top of a standard sized beer cup. The particular Rimmerz shown in FIG. 5 would resemble this cross-sectional view if comprised of four lipped spacers 90 degrees apart (rather than the 120 degree spacings for a 3-lipped variety). Alternately, it would look the same, in partial cross-section, if actually comprised of a single clip, all-around the rim (one piece) variety, described in more detail hereinbelow.

Figure 2:
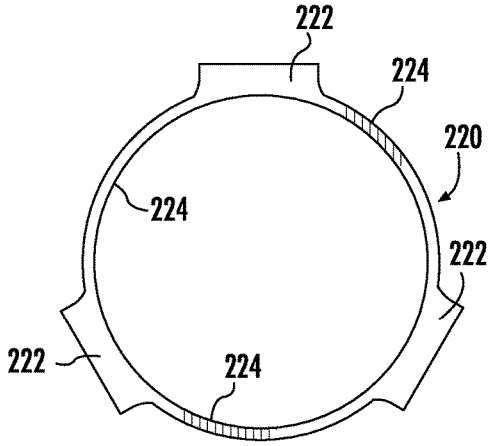
FIG. 2 is a top plan view of a second embodiment, showing the whole rim surround variation with three spaced apart, drink sipping areas.
Figure 3:
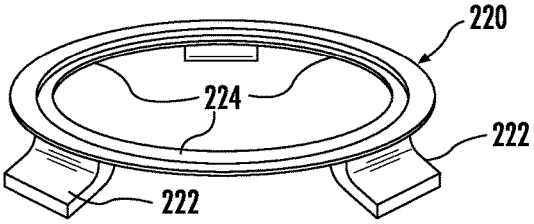
FIG. 3 is a bottom perspective view of the embodiment from FIG. 2 wherein can be seen the groove into which the whole top rim of a small cup is situated.

Because multiple spacer clips might pose a choking hazard (regardless of the degree of sobriety of its user), it is advisable to instead provide smaller cups with a full perimeter surround, i.e., one that goes completely about the upper rim of a smaller disposable shot or mixed drink cup such as one that holds 5, 6 or maybe up to 8 oz. of liquid (read "liquor"). See especially, FIGS. 2 and 3.

Rather than provide a full lip completely around the small, interior cup, one that may be difficult to easily sip the contents from, it is suggested that a full surround, upper lid version, generally 220 have a plurality of overhang regions 222 with three or more spaced sipping regions 224 there between. One way to accomplish same would be to provide a full rim surround 220 with three, possibly four, spacer extensions/protrusions 222 like the version shown in top view at FIG. 2 and in an inverted, perspective view at FIG. 3.

Figure 4:
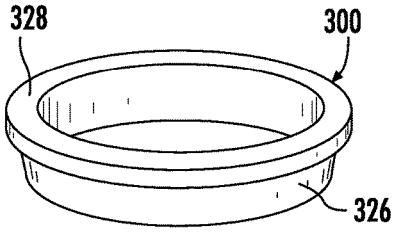
FIG. 4 is a top perspective view of a third embodiment, a whole rim surround but with no sipping area "cutouts", said embodiment also illustrating the inclusion of a message atop a portion of the rim circumference.

If properly constructed from a fuller, thicker "band" of material, a sip-around clip 320 for fitting about the entire top of a small plastic drinking cup/glass may be used as per FIG. 4. That clip may be rimmed so that its lower outer half 326 rests fully inside the upper rim interior of the smaller cup. OR, it may be similarly slotted (not shown) as were the three respective U-shaped clips better seen in FIG. 1.

This variety of FULL Rimmerz clip provides a flat surface 328 on which can be printed advertisements promoting brands and/or various customer products/services including liquid/mixer products, Pong accessories, or munchies and numerous other food products. That space atop Rimmerz 320 may contain beer or other alcoholic company promotions, PSA messages, or sales/redemption coupons. Alternately, it may be banded with various professional sports team colors/logos and/or customized for various college mascots and school colors.

Figure 6:
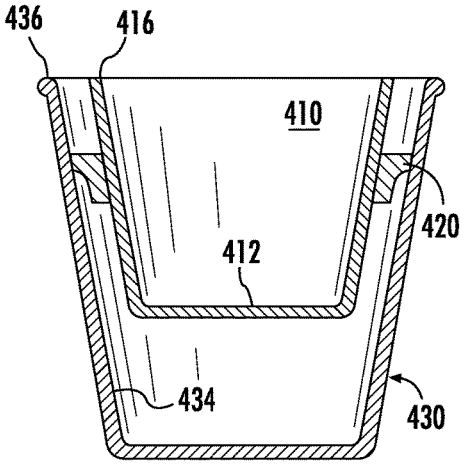
FIG. 6 is a sectional view of the alternate mounting means in which a spacer is situated along the midwall of the smaller cup giving the game play a potentially tougher target with several cups having multiple rims to navigate one's ping pong balls bounces around.

FIG. 6 shows in cross-section yet another variation of Rimmerz cup clip 420, this one meant to rest along and about the sidewall 414 to smaller drinking cup 410 so as to temporarily "wedge" smaller cup 410 inside but comfortably against the innermost sidewall 434 to larger sized cup 430 . . . without having to rest on any portion of the larger cup's upper lip/ledge.

Figure 7:
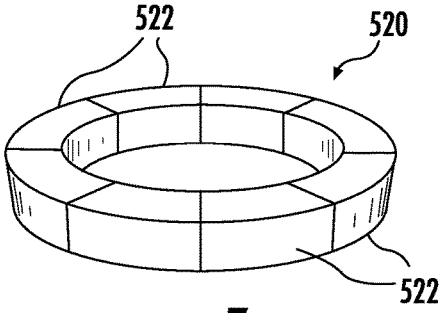
FIG. 7 is a top perspective view, in black and white, showing a preferred embodiment of device which is segmented with multiple arcuate shapes interconnected by elastic means so as to: (1) sufficiently spread for fitting about the midwall of a smaller cup; and then, fitting about a player's body part as a "trophy" upon emptying of the cup's contents.
Figure 8:
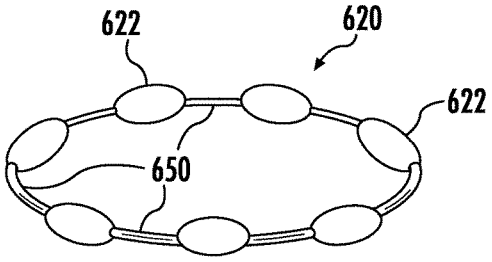
FIG. 8 is a top perspective view of an alternate variation of FIG. 8 showing a plurality of beads interconnected on a display band.

Two versions of that midwall spacer variety of Rimmerz are shown in more detail in the next two views. FIG. 7 shows one variety 520 on an elastic band (not seen) threaded through the various subsections 522 of clip 520. That Rimmerz consists of multiple arches which, when closed together, resemble a more circular-shaped band or bracelet variety. After stretching over a player's body part (wrist, ankle, etc.), this Rimmerz would be able to snap back into shape thereby providing mathematical evidence of how many Rimmerz were "won"/earned during a given night of play. When asked "how many Rimmerz did YOU get last night?", one need merely point to the collection of bands for the answer. FIG. 8 shows a simpler variation 620, consisting of multiple "beads" 622 about a more visible elastic band 650.

The varieties of Rimmerz that extend midway up the sidewalls to a standard clear cup, for fitting in the larger Red "Solo"® cup according to preferred embodiments, may or may not include some adhesive material (not shown) added to one or more segments. The same for the bottom clipped varieties of cups. The staggered rim versions, by contrast, for use with smaller, inner cups having a curved upper rim or other upper protruding ledge, are not intended to have any adhesives combined therewith. They will merely connect the smaller, inner cup by resting ON the Rimmerz' inner staggered rim for a typical game of Beer Pong.

Regardless of the means for connecting to the inner cup, this invention is intended to hold the Rimmer-ed, inner cup in place long enough for a round of Beer Pong play without interfering with play, meaning that it won't cause the inner cup to extend higher than the horizontal surfaces of adjoining, non-Rimmer-ed cups in the typical bowling pin arrangement common for most Beer Pong games. Ideally, when the Rimmer-ed cup (or cups) is (are) kept at about the same level as its "peers", typical bouncing of a ping pong ball towards the array of cups should not be swayed either towards OR away from these higher value cup additions. For the same reasons, Rimmerz additions should not cause a ping pong ball to unintentionally bounce AWAY FROM the set of game cups through mere contact with one or more cup top additions.

The Rimmer additions to an inner cup of hard liquor are never intended to be a permanent addition to that cup. On the contrary, when a player landing in that inner cup has drunk its contents, that player is supposed to remove the Rimmerz and place it around his/her wrist as a pseudo "trophy" band, or at a minimum, as means for keeping track of how many times that evening they landed in an other-than-beer cup.

The present invention may be used for showing school allegiance (i.e., choosing one set of school colors over another), loyalty to professional sports teams (i.e., Go Black-and-Gold) and/or particular brands (i.e., Budweiser, Rolling Rock, Heineken; and/or Captain Morgan Rum, Jack Daniels' whiskey, etc.). These devices can also include true public service announcement/messages like a "PLEASE PONG RESPONSIBLY" top surround.

Figure 9:
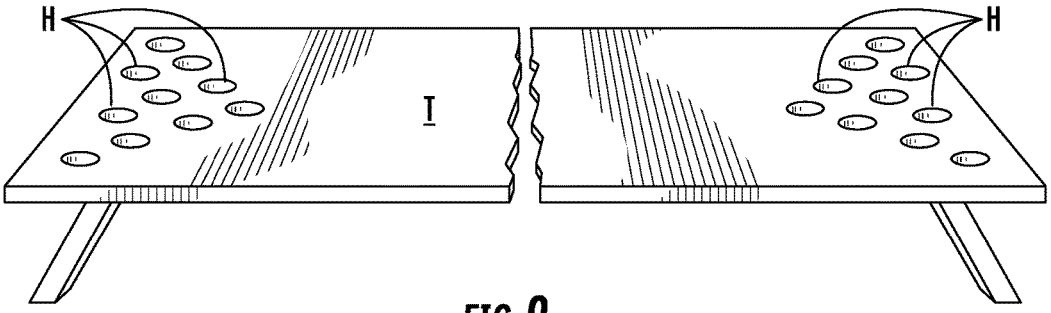
FIG. 9 is a top perspective view of a typical pong playing table with two opposed playing "courts" showing the typical 10 pin/cup arrangement at each end. In this case, the table includes 10 commonly sized holes arranged in rows of 1, 2, 3 and 4 for holding (at least midway) large drinking cups containing a beverage, most often beer.
Figure 10:
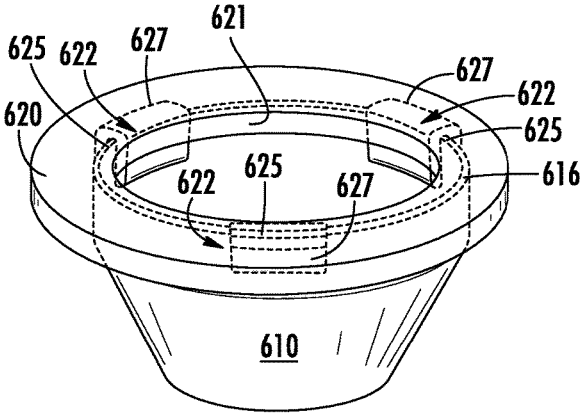
FIG. 10 is a top perspective view of another variation of the invention in which an upper rim covering has three (representative) clips for temporarily holding onto a small inner cup for use in a modified Beer Pong game hereby.
Figure 11:
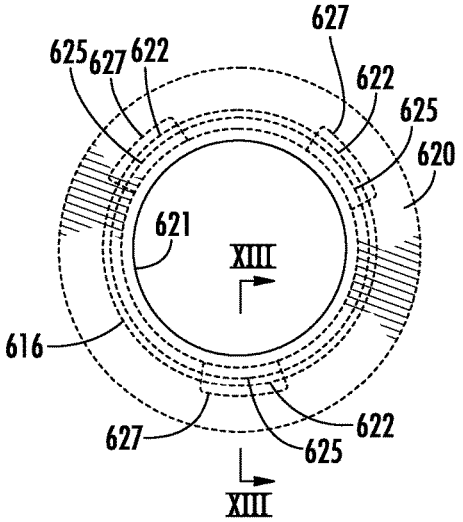
FIG. 11 is a top view of the upper rim cover and cup from FIG. 10.
Figure 12:
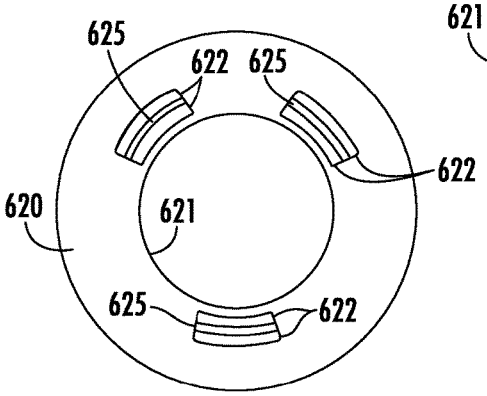
FIG. 12 is a bottom view of just the upper rim cover from FIG. 10.

With the Rimmerz of this invention, Pong playing can be instantly taken to newer levels of competition. One NOT need have modified playing boards/tables with different sized cup holes/holders to accomplish variable size drinking targets and differing contents therein. There can still be the standard table (element T in FIG. 9) each end of which has multiple cup holes H, like the 10 hole bowling-like arrangement depicted but with varying arrangements containing harder liquor targets in the smaller cups "Rimmer-ed" into one or more of the larger beer cups already situated in the playing "field". For instance, smaller cup varieties of whiskey, rum, gin, even Jello® shots, may be situated in alternating rows (the first and third; or second and fourth), in a diamond pattern or just the center hole (where bowling pin #5 sits, or the center 8 ball in a game of billards). Alternately, the game can include a smaller shot-glass (with Rimmerz) as just the front pin, a full back row of Rimmerz containers or possibly have additional rows/holes to a competition table specially fitted with Rimmerz alternatives.

FIGS. 10 through 13B address another embodiment of this invention in which Rimmerz clip 620 is affixed to the uppermost rim 616 of inner cup 610 via a series of downwardly extending clips 622. Note that 3 representative clips are depicted in these drawings. It is believed that at least 2 such clips should be included (depending on the overall length of curvature of such clips). Alternately, 4 clips stationed 90 degrees apart can be provided, or even 5 or more (smaller curvature) clips than what is currently shown. Their purpose is to temporarily hold onto that uppermost rim 616 for the playing of a Beer Pong game therewith.

In the variation shown at FIGS. 10 through 13A, each downward clip 622 has a top section 627 affixed to (or extending integrally from) an underside to Rimmerz clip 620 slightly inward from the inner rim 621 of clip 620. Alternately, these same plurality of downward clips 622 may extend from the very, innermost edge of inner rim 621.

Each clip 622 includes a groove 625 for contacting with the uppermost rim 616 of inner cup 610. That groove is shown as being in the middle of the underside to clip 622. It is understood that alternative variations (not shown) may include grooves that are NOT central to each clip but rather closer to a forward edge OR to the rear edge of a clip configuration depending on: ease of manufacture and/or stability of an installed clip onto its inner cup uppermost rim.

Figure 13A:
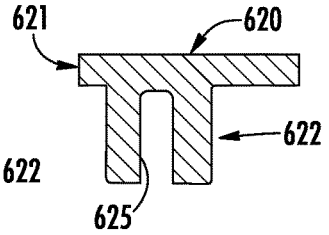
FIG. 13A is a sectional view of just the upper rim cover as would be seen taken along lines XIII-XIII of FIG. 11.
Figure 13B:
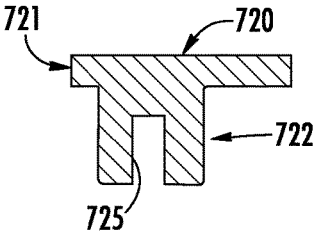
FIG. 13B is another variation of sectional view similar to that of FIG. 13A exhibiting a different manufacturing means, namely a whole clip beneath a whole upper rim cover.

FIG. 13A shows one means of clip 622 manufacture in which the inner rim 621 of Rimmerz clip 620 has a somewhat Pi-shaped appearance, with a continuous, integrally formed pair of downward extensions forming the groove 625. FIG. 13B shows another variation of that same cross-section but in this alternative, the downward clip 722 of Rimmerz clip 720 therein has more of a two-piece feel, with a U-shaped pair of extensions defining alternate groove 725 and both legs of those U-shaped extensions protruding down from a more common planar component that starts at innermost edge 721 of Rimmerz clip 720. Note, that one preferred means of manufacturing the clip of FIG. 13B would be to integrally cast, 3D print, etc. the U-shape and top planar portions together. Alternately, it may be more cost effective to make them into separate components (i.e., the U-shape clips separate from the Rimmerz top planar portion) and then glue or otherwise adhere them into one common clip unit.

Figure 14:
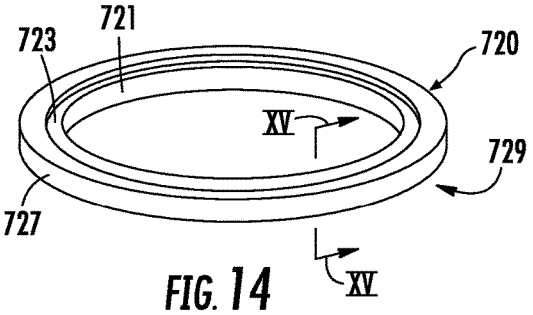
FIG. 14 is a top perspective view of yet another Rimmerz variation with a downwardly beveled (or staggered) innermost ledge, for use with inner cups having an outwardly curved upper lip or other similar protrusion.
Figure 15:
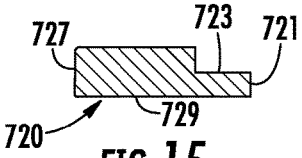
FIG. 15 is a sectional view of just the upper rim cover from FIG. 14 as if seen along lines XV-XV therein.
Figure 16:
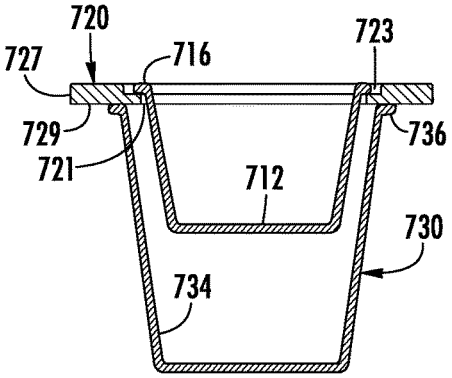
FIG. 16 is a side sectional view showing the Rimmerz variation from FIG. 14 installed on an inner (lipped) cup that has been inserted into (and onto) an outer, typical beer pong, larger lower cup.

FIGS. 14 through 16 show yet another variation of Rimmerz clip 720 but for particularly preferred inner cup configurations, namely those inner cups 712 having a curvy, lipped or otherwise partially outwardly protruding component 716. When an underside 729 of Rimmerz clip 720 is merely rested on the uppermost rim 736 to sidewall 734 of outer cup 730, this last variation of Rimmerz clip 720 includes a purposefully staggered or beveled innermost ledge 723 so as to be noticeably thinner in cross section than the outer ledge 727 of Rimmerz clip 720. That beveling, as best seen in FIG. 16, lets the protrusion 716 of inner cup 712 simply sit on innermost ledge 723 of Rimmerz clip 720 during a game of Beer Pong, without the need for any adhesion between Rimmerz clip and inner cup whatsoever.

Note that the continuous band of this invention can be made from a flexible/bendable or otherwise malleable material (elastic being preferred). Or, if made from a semi-rigid or rigid composition, it must be able to be readily slipped onto or off of a human wrist as part of means for using this invention as a device for counting the number of times an individual game player has landed his/her ping pong ball in the smaller diameter cup and had to drink its non-beer (second beverage) contents as a direct result thereof.

With regard to this latest innovation, it is preferred that edible materials be used to construct any one or more of the aforementioned models of cup adapter devices. Particularly, it is perceived that true Rimmerz clips and/or inner cup lip rests be made from a cookie-type recipe that would have the appropriate trademarks and other brand identifiers included. Suitable cookies include those used to make: Lorna Doone's, Nilla Wafers, graham crackers, Oreos, Nutter Butters and many more.

For still other edible alternatives, consider making these drink cup adapters from the waffly material of an ice cream cone, sugar OR cake. Or, they can be made from pretzel or cracker stock, like those for Cheezits and/or Goldfish. Still other rims can be made from various compressed compositions of popular cereal brands, including Cheerios, Frosted Flakes, and even Shredded Wheat.

Finally, there is a family of various candy products that can be adapted for making these Rimmerz alternatives. They include a line of gum or "gummi" products such as Razzles, gumdrops, gummi bears, Swedish Fish, Starburst, Airheads, and still other Wax Lips, saltwater taffy, Starburst, and/or other taffy-type variations. They could also be made from chocolate, or molded from rock candy-type consistencies. It is also conceivable to make these edible alternatives from compacted sugar powder materials like those used to make: Smarties, Sweetarts, and Necco wafers to name just a few.

Having described the presently preferred embodiments, it is to be understood that the scope of this invention may be further described by the scope of the accompanying drawings and the following claims.

What is claimed is:

1. A device adapted for contacting with an uppermost lipped rim of a smaller diameter cup to enable the lipped rim of the smaller diameter cup to rest on the device while the device rests on an uppermost rim of a larger diameter cup for a beer pong drinking game that stores beer in the larger diameter cup and a second beverage in the smaller diameter cup, said device comprising:

a continuous, substantially planar band, circular in shape, said planar band: (i) having a recessed upper ledge onto which the lipped rim of the smaller diameter cup is rested when the smaller diameter cup is positioned in the device, and (ii) having a substantially planar underside adapted for temporarily resting on the uppermost rim of the larger diameter cup during play of the beer pong drinking game.

2. The device of claim 1, which is capable of being worn as a wristband.

3. The device of claim 1 wherein the continuous band is bendable.

4. The device of claim 3 wherein the bendable continuous band is made from an edible material.

5. The device of claim 4 wherein the edible material is selected from a candy.

6. The device of claim 5 wherein the candy is selected from the group consisting of: a Gummi bear material, Swedish fish material, Starburst, a saltwater taffy material, wax lips and Airheads candy.

7. The device of claim 1 wherein the continuous band is rigid.

8. The device of claim 7 wherein the rigid continuous band is made from an edible material.

9. The device of claim 8 wherein the edible material is a cookie.

10. The device of claim 9 wherein the cookie is selected from the group consisting of: graham crackers, Lorna Doone, Nutter Butter and Nilla wafer.

11. The device of claim 8 wherein the edible material is a cereal, a pretzel or a cracker.

12. The device of claim 8 wherein the edible material is a candy.

13. The device of claim 12 wherein the candy is selected from the group consisting of rock candy, Razzles, Smarties, Starburst, Sweetarts and Necco wafer.

14. The device of claim 1, which can be removed and worn as a non-beer drink counter.

15. The device of claim 1 wherein the continuous band has a surface onto which one or more messages may be printed.

16. An edible device adapted for contacting with a smaller diameter cup to enable an upper rim of the smaller diameter cup to sit flush with an uppermost rim of a larger diameter cup for a beer pong drinking game that stores beer in the larger diameter cup and a second beverage in the smaller diameter cup, said edible device comprising:

a continuous, circular band for situating temporarily along an upper exterior of the smaller diameter cup or adjacent the upper rim of the smaller diameter cup so as to enable the upper rim of the smaller diameter cup to sit flush with the uppermost rim of a larger diameter cup for the beer pong drinking game, said circular band being further adapted for removal from the smaller diameter cup for either wearing on a human wrist as a drink counter or being eaten after a ping pong ball, from the beer pong drinking game, has landed in the smaller diameter cup and the second beverage contained therein has been consumed.

17. The edible device of claim 16 wherein the continuous band is flexible.

18. The edible device of claim 17, which is made from a candy.

19. The edible device of claim 16 wherein the continuous band is rigid.

20. The edible device of claim 19, which is made from a cookie, a pretzel, a cracker or a candy material.

* * * * *